US007544909B2

(12) United States Patent
Dhir

(10) Patent No.: US 7,544,909 B2
(45) Date of Patent: Jun. 9, 2009

(54) ILLUMINATED CABLE

(76) Inventor: Alok K. Dhir, 8610 Hartsdale Ave., Bethesda, MD (US) 20817

( * ) Notice: Subject to any disclaimer, the term of this patent is extended or adjusted under 35 U.S.C. 154(b) by 332 days.

(21) Appl. No.: 11/605,676

(22) Filed: Nov. 29, 2006

(65) Prior Publication Data

US 2008/0102689 A1 May 1, 2008

Related U.S. Application Data

(63) Continuation-in-part of application No. 11/586,388, filed on Oct. 25, 2006.

(51) Int. Cl.
*H01R 33/96* (2006.01)

(52) U.S. Cl. ..... 200/51.12; 200/51.11

(58) Field of Classification Search ..... 200/51.05, 200/51.09, 51.11–51.12, 51 R; 439/490, 439/502, 651, 488–491, 650–655, 505, 95, 439/624

See application file for complete search history.

(56) References Cited

U.S. PATENT DOCUMENTS 4,969,833 A * 11/1990 Lindow et al. ..... 439/133
4,969,834 A * 11/1990 Johnson ..... 439/141
5,007,857 A * 4/1991 Wright ..... 439/490
5,277,620 A * 1/1994 Taylor ..... 439/490
5,567,175 A * 10/1996 Warden et al. ..... 439/490
5,666,453 A 9/1997 Dannenmann
6,532,328 B1 3/2003 Kline
6,577,243 B1 6/2003 Dannenmann et al.
6,710,254 B2 * 3/2004 Yueh ..... 174/135
6,825,427 B2 * 11/2004 Jenks ..... 200/51.12
6,969,273 B2 * 11/2005 Chen ..... 439/490
6,975,242 B2 12/2005 Dannenmann et al.
6,979,223 B2 * 12/2005 Chen ..... 439/490
6,979,787 B2 * 12/2005 Davies ..... 200/51 R
7,029,137 B2 4/2006 Lionetti et al.
7,038,135 B1 5/2006 Chan et al.
7,049,937 B1 5/2006 Zweig et al.
7,332,682 B2 * 2/2008 Kim ..... 200/18
2005/0124209 A1 6/2005 Currie et al.
2006/0057876 A1 3/2006 Dannenmann et al.

FOREIGN PATENT DOCUMENTS

JP 1-315974 12/1989

* cited by examiner

*Primary Examiner*—Lincoln Donovan
*Assistant Examiner*—Lisa N Klaus
(74) *Attorney, Agent, or Firm*—The Marbury Law Group, PLLC

(57) ABSTRACT

A power cable has LEDs embedded the connectors at both ends. Switches at both ends are used to selectively energize the LEDs. Actuating a switch on one end of the cable will light up an identifying LED on the other end of that same cable and optionally at both ends of that cable.

4 Claims, 4 Drawing Sheets

ILLUMINATED CABLE

CROSS REFERENCE TO RELATED APPLICATION

This application is a continuation-in-part of application Ser. No. 11/586,388, filed Oct. 25, 2006, which is incorporated by reference herein, for all purposes.

FIELD OF THE INVENTION

The present invention is directed to the field of power cords that carry electrical power from a power source socket to a power using device.

BACKGROUND INFORMATION

A problem for datacenters where a large number of computers are installed in a rack is that it becomes difficult to tell which machine's cord (or cords) are plugged into which receptacle. Modern server computers have at least two power connections per server, which further compounds the problem. This problem exists across all kinds of datacenters where substantial numbers of servers, telephone switch gear (e.g., private branch exchange (PBX)), or other data handling systems are being used.

Power cords have been developed that illuminate at the female end of the cord to provide an indication that the male end is plugged into a socket and, thus, energized. This in not helpful in differentiating between plural power cords since all energized power cords using this technology are simultaneously illuminated.

It has been proposed to illuminate the length of a network cable with a fiber optic structure embedded along the length of the cord. This is not useful in differentiating between plural cables, nor even which cable is plugged in on one end or the other, since illumination is by unswitched battery power and all cables will be illuminated. For additional details, refer to U.S. Pat. No. 7,029,137.

What is needed is a way to selectively identify from one end of a power cord the opposite end of that same power cord in a way that can be differentiated among many similar looking cords.

SUMMARY OF THE INVENTION

A power cable is modified to have LEDs embedded the connectors at both ends. Switches at both ends are used to selectively energize the LEDs. Actuating a switch on one end of the cable will light up an identifying LED on the other end of that same cable.

In one embodiment, when a button is pressed on either end of the power cable, the corresponding other end's LED lights up.

In another embodiment, when a button is pressed on either end of the power cable, the LEDs at both ends light up.

In yet another embodiment, when a button is pressed on either end of the power cable, both LEDs light up and the light is conducted along the cable to provide illumination along the entire cable length.

Power for the switched LED circuits is drawn from power conductors of the cable.

DETAILED DESCRIPTION

A power cable has LEDs embedded in the connectors at both ends. Switches at both ends are electrically connected to selectively energize the LEDs. Actuating a switch on one end of the cable will light up an identifying LED on the other end of that same cable.

Figure 1:
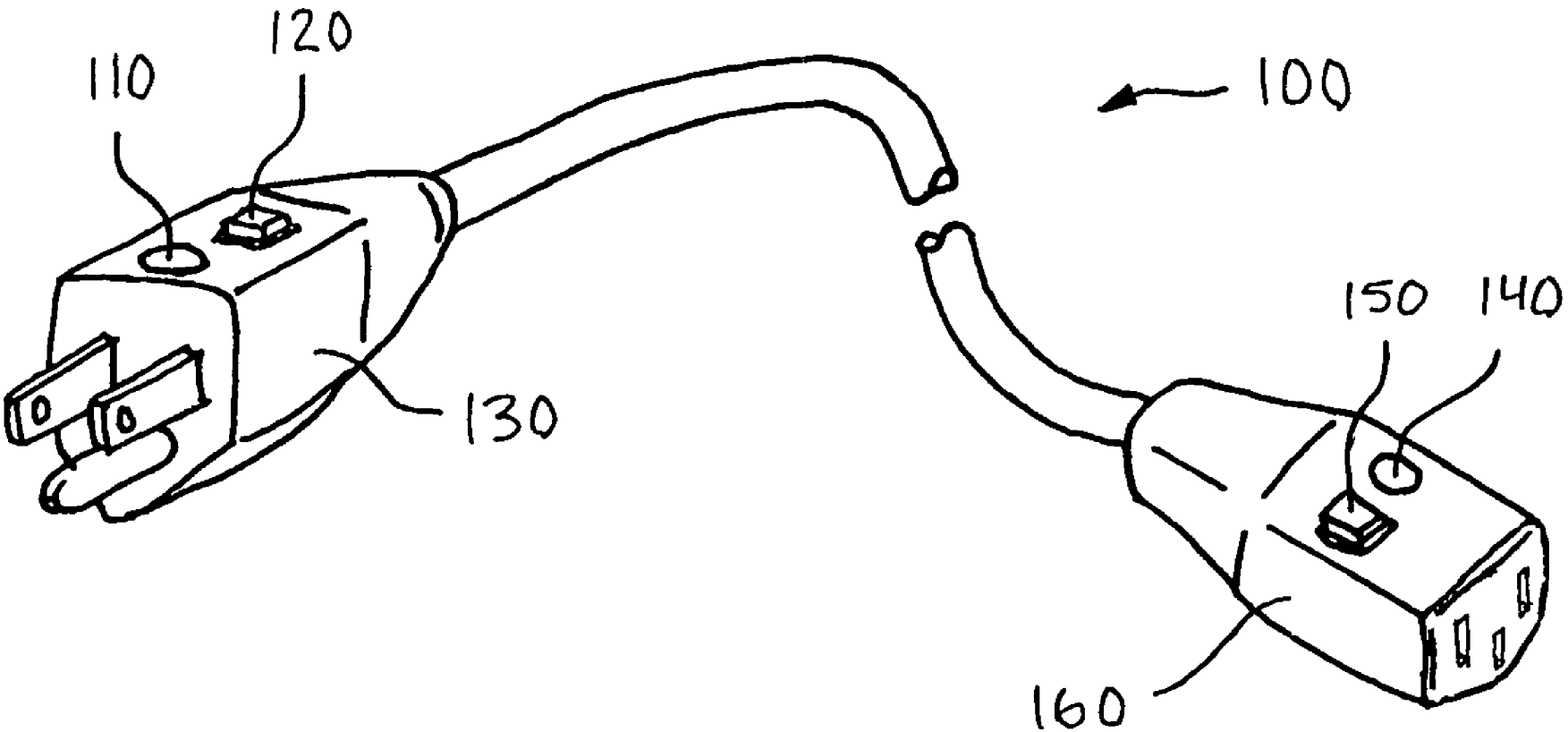
FIG. 1 illustrates a partial perspective view of a power cable with illumination circuitry according to various embodiments.

Referring to FIG. 1, partial perspective view of an embodiment of a power cable 100 is illustrated. A first LED 110 and a first switch 120 are shown at the male end 130 of the power cable 100. A second LED 140 and a second switch 150 are shown at the female end 160 of the power cable 100.

Figure 2:
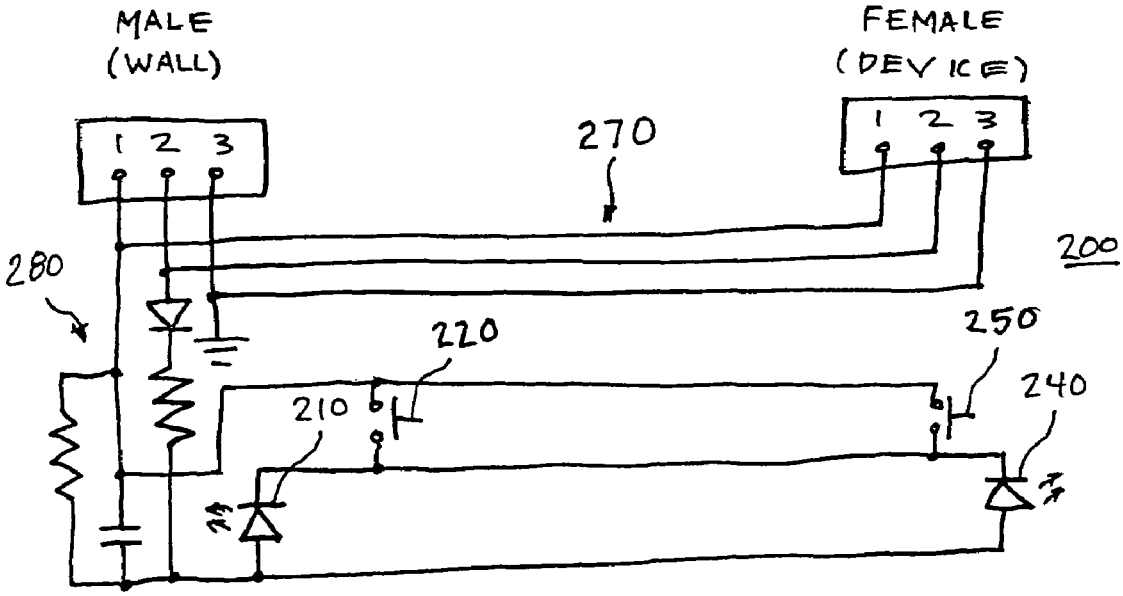
FIG. 2 illustrates a schematic diagram of a power cable with switched illumination circuitry according to one embodiment.

Referring to FIG. 2, circuitry for one embodiment of the power cable is illustrated by a schematic diagram. Two LEDs 210, 240 at the male 230 and female 260 ends of the power cable 200 are actuated by switches 220, 250 that are also disposed at the opposed male 230 and female 260 ends. Actuation of either of the momentary contact switches 220, 250 energizes the LEDs 210, 240 using power derived from the main power conductors 270 of the power cable 200 via a power conditioning circuit 280. A simple power conditioning (or power supply) circuit 280 illustrated uses a simple rectifier diode, resistive voltage divider and capacitor configuration, but any of various known power supply/conditioning circuits may alternatively be used as is known by those of skill in the art.

Figure 3:
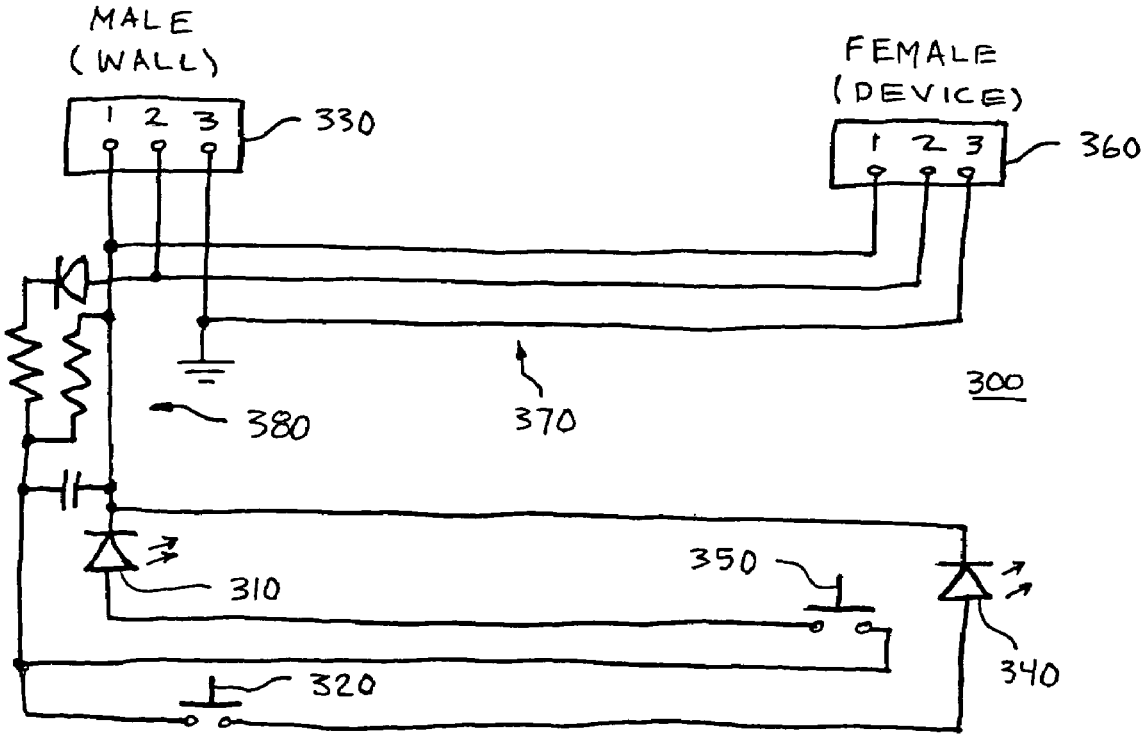
FIG. 3 illustrates a schematic diagram of a power cable with switched illumination circuitry according to another embodiment.

Referring to FIG. 3, a schematic diagram of a circuit according to an additional embodiment is illustrated. A male end LED 310 is connected in a circuit to be energized by closing of a female end switch 350. A female end LED 340 is connected in a circuit to be energized by closing of a male end switch 320. For each of these circuits, power is provided from connection to the main power conductors 370 of a power cable 300 via a power conditioning circuit 380. The male end LED 310 and the male end switch 320 are disposed adjacent the male connector 330, and the female end LED 340 and the female end switch 350 are disposed adjacent the female connector 360.

Figure 4:
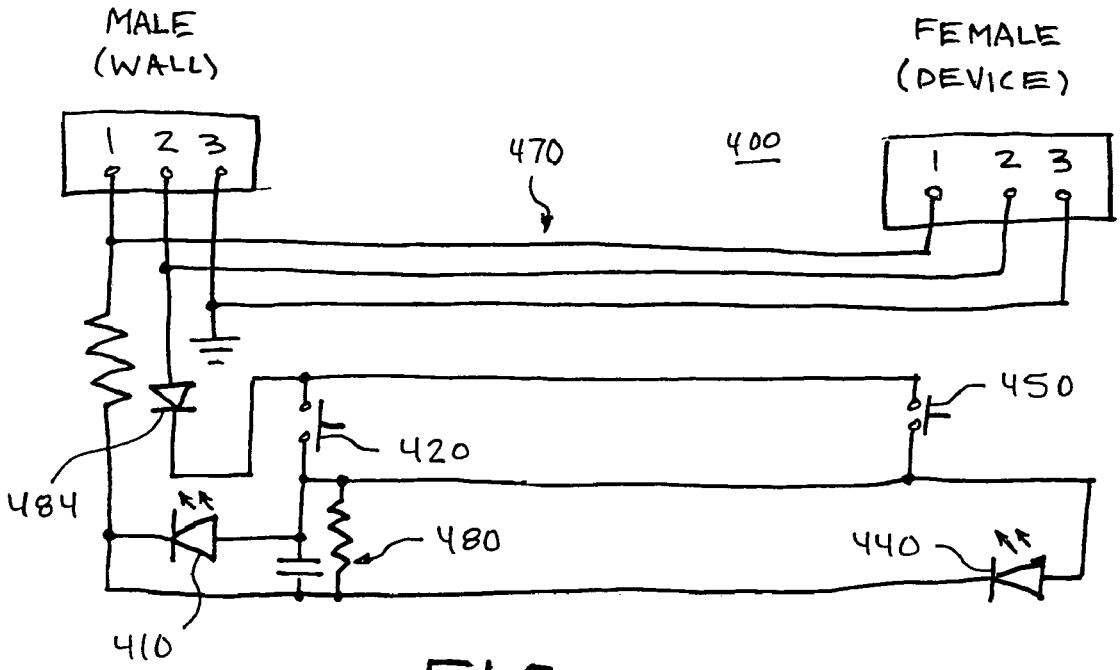
FIG. 4 illustrates a schematic diagram of a power cable with switched illumination circuitry according to yet another embodiment.

Referring to FIG. 4, circuitry for another embodiment of the power cable is illustrated by a schematic diagram. A male end LED 410 and a female end LED 440 are connected in a circuit to be energized by closing of a female end switch 450 or a male end switch 420. Power for this circuit is provided from connection to the main power conductors 470 of a power cable 400 via a power conditioning circuit 480 that includes a rectifier diode 484.

Figure 5:
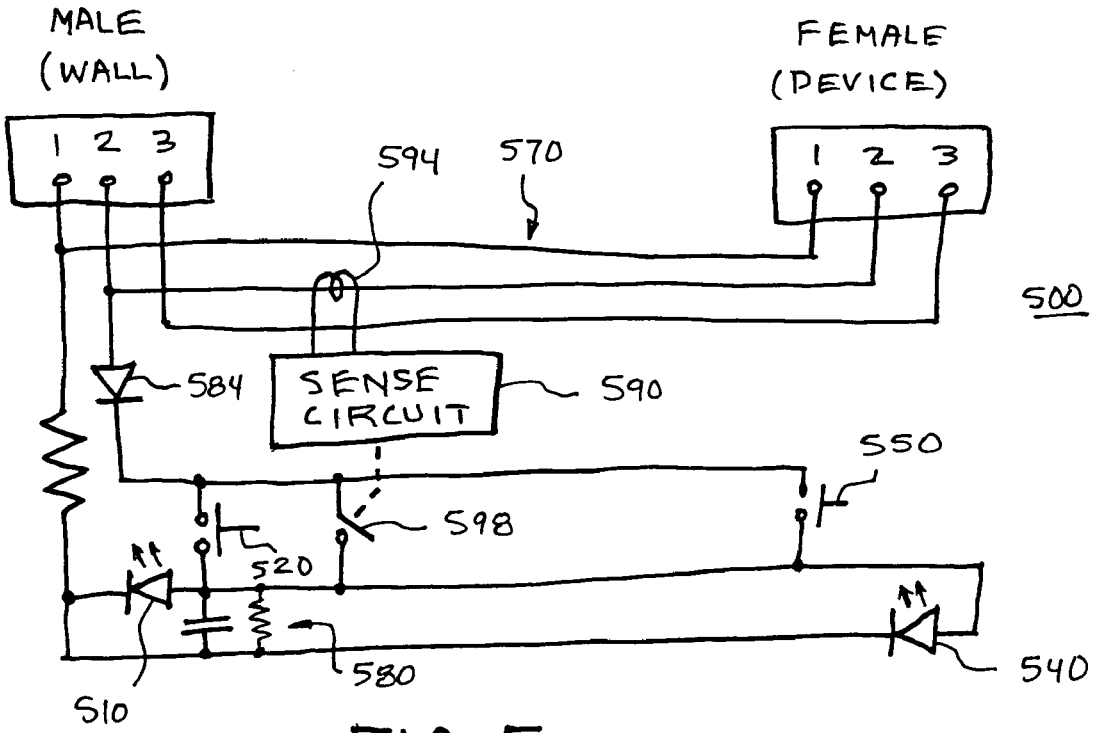
FIG. 5 illustrates a schematic diagram of a power cable with switched illumination circuitry according to still another embodiment.

Referring to FIG. 5, circuitry for another embodiment of the power cable is illustrated by a schematic diagram. A male end LED 510 and a female end LED 540 are connected in a circuit to be energized by closing of a female end switch 550 or a male end switch 520. Power for this circuit is provided from connection to the main power conductors 570 of a power cable 500 via a power conditioning circuit 580 that includes a rectifier diode 584. Additionally, a sense circuit 590 detects using a current transformer 594 when load is not being drawn by the device and automatically actuates a switch 598 to energize the LEDs 510, 540.

According to the embodiment of FIG. 5, which is useful for server computers, the LEDs 510, 540 on the power cable light when there is a failure of the power supply inside the server to which the power cable is connected. Failure of the server power supply is detected by the sense circuit 590, which senses power load being drawn through the power cable and detects the catastrophic drop in load. As an optional feature, the power cable is combined with an integrated buzzer to buzz when a server power supply unit fails.

Figure 6:
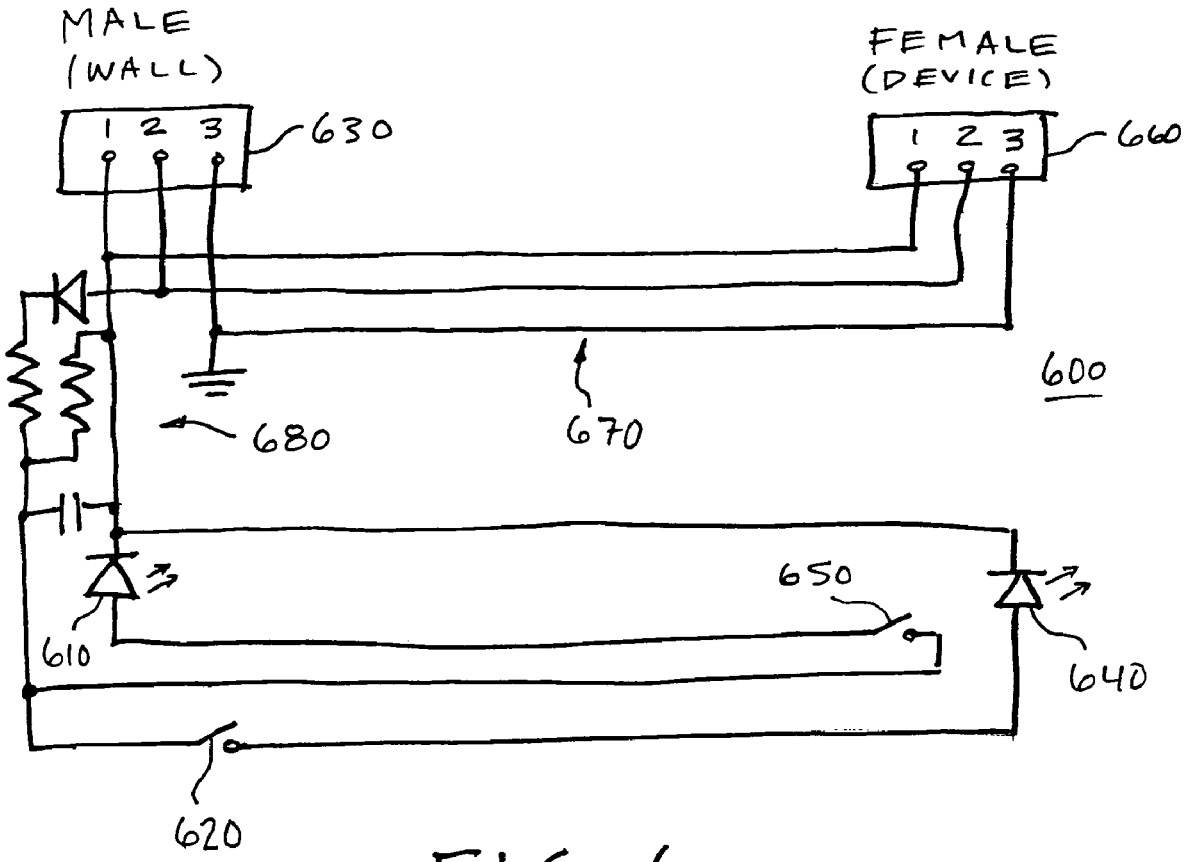
FIG. 6 illustrates a schematic diagram of a power cable with switched illumination circuitry according to a further embodiment.

Referring to FIG. 6, a schematic diagram of a circuit according to an additional embodiment is illustrated. A male end LED 610 is connected in a circuit to be energized by closing of a female end toggle switch 650. A female end LED 640 is connected in a circuit to be energized by closing of a male end toggle switch 620. For each of these circuits, power is provided from connection to the main power conductors 670 of a power cable 600 via a power conditioning circuit 680. The male end LED 610 and the male end switch 620 are disposed adjacent the male connector 630, and the female end LED 640 and the female end switch 650 are disposed adjacent the female connector 660. Since the toggle switches 620, 650 maintain a stable position (either open or closed, as selected) the LEDs 610, 640 may be maintained in an on or off state indefinitely as needed for troubleshooting purposes.

According to one alternate embodiment, the power cable is combined with an RFID transmitter that triggers upon illumination of the power cable's LEDs so as to broadcast an identification signal to provide an RF alert of server power supply failure.

According to another alternate embodiment, each LED is mounted to the power cable using a modular connector that enables field replacement of the LEDs.

According to still another alternate embodiment, the power cable's LEDs are manufactured in a variety of colors that are useful to represent distinct types of equipment to which they are attached, or to represent any other chosen meaning.

Since the LED alert circuits are implemented with power cables from which they can draw power, these alert circuits do not require external power, such as a battery. When embodied with a power cable, the LED alert circuits utilize the current already running through the power conductors of the power cable.

An advantage of using LEDs for these embodiments is that modern LEDs are very bright while having a very small current draw. Thus, even if the LED alert circuits are "on" for extended periods, there would be a minimal additional power load (an estimated 0.5 Watt power load—the same draw as an LED on the front of a typical computer). Another advantage of LEDs is that they are very long lasting (50 k-100 k hrs). Another advantage of LEDs is that they are very inexpensive.

A power cord with selectively energized LEDs has been described. It will be understood by those skilled in the art that this technology may be embodied in other specific forms without departing from the scope of the inventions disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A power cable comprising:

a first connector at a first end of the cable;

a second connector at a second end of the cable;

power conductors extending through the cable from the first connector to the second connector;

a circuit comprising:

a first switch disposed at the first connector;

a second switch disposed at the second connector and electrically connected in parallel with the first switch;

a first light emitting diode disposed at the first connector and electrically connected in series with the parallel combination of the first and second switches; and a second light emitting diode disposed at the second connector and electrically connected in series with the parallel combination of the first and second switches;

wherein the circuit receives electrical power from the power conductors.

2. The power cable of claim 1, wherein the first switch comprises a normally open momentary contact switch, and wherein the second switch comprises a normally open momentary contact switch.

3. The power cable of claim 1, wherein the first switch comprises a toggle switch, and wherein the second switch comprises a toggle switch.

4. A power cable comprising:

a first connector at a first end of the cable;

a second connector at a second end of the cable;

power conductors extending through the cable from the first connector to the second connector;

a first switch disposed at the first connector and electrically connected to operate a first light emitting diode disposed at the second connector; and a second switch disposed at the second connector and electrically connected to operate a second light emitting diode disposed at the first connector;

wherein the first and second light emitting diodes receive electrical power from the power conductors.

* * * * *